United States Patent [19]

Levine et al.

[11] 4,365,754

[45] Dec. 28, 1982

[54] SPRAY ASSEMBLY CONSTRUCTION

[75] Inventors: Walter E. Levine; Allan B. Heath, both of Port Huron, Mich.

[73] Assignee: Acheson Industries, Inc., Port Huron, Mich.

[21] Appl. No.: 161,060

[22] Filed: Jun. 19, 1980

[51] Int. Cl.[3] ..... B05B 7/12

[52] U.S. Cl. ..... 239/412; 239/434; 137/605; 251/63; 251/63.5

[58] Field of Search ..... 239/407, 412, 434; 184/55 A, 55 R; 251/63, 63.5; 164/149; 137/605

[56] References Cited

U.S. PATENT DOCUMENTS

| | | | |
|---|---|---|---|
| 1,077,795 | 11/1913 | Burns | 251/63 |
| 1,975,067 | 9/1934 | Colclasure | 239/434 |
| 3,182,950 | 5/1965 | Stone | 251/63 |
| 3,393,658 | 7/1968 | Ott . | |
| 3,394,888 | 7/1968 | Dasse et al. . | |
| 3,512,550 | 5/1970 | Ammann | 251/63 X |
| 3,561,680 | 2/1971 | Ott | 239/411 |
| 3,779,305 | 12/1973 | Pondeicek et al. | 164/312 |
| 3,807,641 | 4/1974 | Albright | 239/412 |
| 3,888,420 | 6/1975 | Boelkins | 239/412 |
| 3,902,663 | 9/1975 | Elmer | 236/87 |
| 3,920,099 | 11/1975 | Pondelicek | 184/55 |
| 3,995,717 | 12/1976 | Kroffke | 184/7 |
| 4,027,744 | 6/1977 | Kuhnelt et al. | 184/7 |
| 4,041,899 | 8/1977 | Wolfe et al. | 118/323 |

OTHER PUBLICATIONS

Rimrock Nozzles 030 031 040 & 040-0080-54 & Trouble Shooting Automatic Spray Systems, Rimrock Corp., Columbus, Ohio.

Dag Spray Nozzles 015 035 036 & 048, Deutsche Acheson, GmbH, Postfach 1165, 7900 Ulm-Donau, West Germany.

*Primary Examiner*—Andres Kashnikow
*Assistant Examiner*—Paul A. Sobel
*Attorney, Agent, or Firm*—Harness, Dickey & Pierce

[57] ABSTRACT

A spray assembly including an improved control valve is disclosed which is designed for heavy industrial usage to enable application of air and/or atomized liquids to be applied to the working surfaces of various types of forming apparatus such as molds and dies for example. The control valve utilized in the spray assembly of the present invention incorporates a piston actuated plunger assembly which is designed for extremely rapid operation whereby substantially maximum liquid fluid flow may be obtained almost instantaneously. Additionally, the spray assembly is designed so as to enable application of either one fluid alone such as blow air or both air and liquid. Also, the plunger is positioned so as to provide substantially unobstructed liquid flow into the air stream for atomization when in a fully open position thereby enabling large volumes of liquid to be applied within relatively short cycling time. An adjustable stop is also provided so as to allow modulation of the liquid flow should this be desired. Only a single moving valve member is required which is controlled by pressurized air so as to provide extremely rapid on/off cycling thereby assuring long dependable operation as well as enabling relatively rapid repair.

19 Claims, 3 Drawing Figures

SPRAY ASSEMBLY CONSTRUCTION

BACKGROUND AND SUMMARY OF THE INVENTION

The present invention relates generally to spray assemblies and control valves associated therewith and more particularly to such spray assemblies and control valves which are particularly designed for heavy industrial use in cleaning and applying liquids to the working surfaces of molds and dies between operation thereof.

In many industrial forming processes, such as the molding, die-casting, drawing, and forging of various metals or other similar materials, it is necessary to apply a lubricant to the working surfaces of such dies or other forming apparatus between machine-cycle operations. Also, it is often desirable to blow air across these working surfaces to remove scale, sediment or other impurities which may have remained adhered thereto from previous operational cycles. Further, the application of air and lubricant to these working surfaces tends to cool the dies between operational cycles thereby prolonging the life of the dies. In certain cases it may also be desirable to apply a suitable release agent to promote removal of the finished article upon completion of the operational cycle.

In such applications it is very desirable to have spray assemblies which have the capability to apply relatively large volumes of fluid in a short period of time so as to enable the forming apparatus to be rapidly cycled. Accordingly, such spray assemblies should have rapidly actuable valve assemblies which provide a relatively unobstructed flow path for the liquid to be applied. Additionally, in order to minimize the necessary equipment surrounding the forming apparatus, it is desirable to provide such spray assemblies with the capability of applying both blow air to working surfaces so as to remove debris, scale, etc., as well as the desired liquids.

Additionally, because such spray assemblies are subject to rough treatment and extremely adverse operating conditions both in terms of the nature of the liquids they may be used in conjunction with as well as the operating environment, it is important that they be extremely rugged and dependable in operation. Also, because the liquids being applied by such apparatus may often contain abrasive materials, it becomes difficult to provide valve structures which afford a reasonably long useful life.

The present invention, however, provides an improved spray assembly having a minimal number of moving parts and which provides dual capability of applying either blow air alone or atomized liquids to the working surfaces of such forming apparatus. Additionally, because the valve structure of the present invention is designed to be actuated by a separate supply of control air and provides a relatively large surface area against which the air operates, extremely rapid on/off cycling thereof is obtained whereby maximum liquid flow is obtained almost instantaneously. The valve chamber is also provided with a stainless steel liner so as to provide long wear even when relatively abrasive liquids are being applied. Additionally, the spray assembly of the present invention may be easily and rapidly manufactured at relatively low cost while also providing a strong durable long lasting compact spray assembly which provides good atomization of the liquid yet may also be utilized to apply only blow air for cleaning and/or cooling of the working surfaces.

Additional advantages and features of the present invention will become apparent from the subsequent description and the appended claims taken in conjunction with the accompanying drawings.

DESCRIPTION OF THE PREFERRED EMBODIMENT

Figure 1:
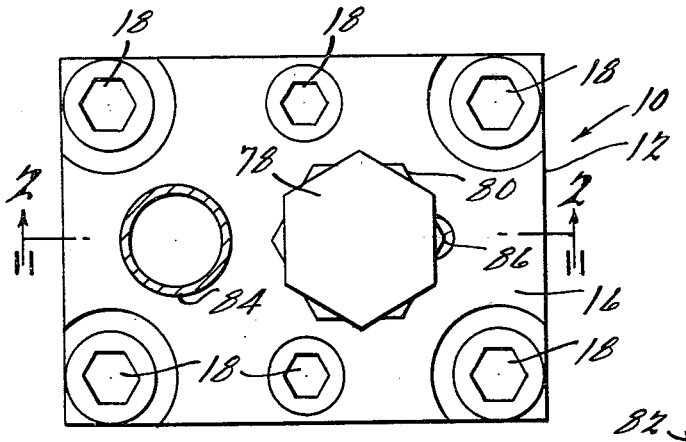
FIG. 1 is an end view of the spray assembly of the present invention having the outlet conduit shown in section.

Referring now to the drawings, there is shown a spray assembly in accordance with the present invention indicated generally at 10. Spray assembly 10 is designed specifically for heavy industrial use in applying both blow air and atomized liquids to the working surfaces of various types of molds and dies and may be used in conjunction with various types of equipment which are adapted to automatically reciprocate a head having a plurality of such spray assemblies secured thereto into and out of an open die or mold. A device of this type is disclosed in U.S. Pat. No. 4,041,899 issued Aug. 16, 1977 and assigned to the same assignee as the present invention, the disclosure of which is hereby incorporated by reference thereto. Alternatively, spray assembly 10 may be secured in a stationary position adjacent the die or mold and positioned so as to be able to apply such fluids thereto.

Spray assembly 10 comprises a main body housing 12 of generally elongated rectangular shape which is preferably fabricated from aluminum material and has an inlet plate 14 and outlet plate 16 secured to opposite ends 24 and 30 thereof by means of a plurality of suitable fasteners 18 extending therethrough. Suitable gasket means 21 and 23 are positioned between respective inlet and outlet plates 14 and 16 and opposite ends 24 and 30 so as to create a sealing relationship therebetween. A liquid supply valving assembly 19 is also provided being disposed within housing 12.

Figure 2:
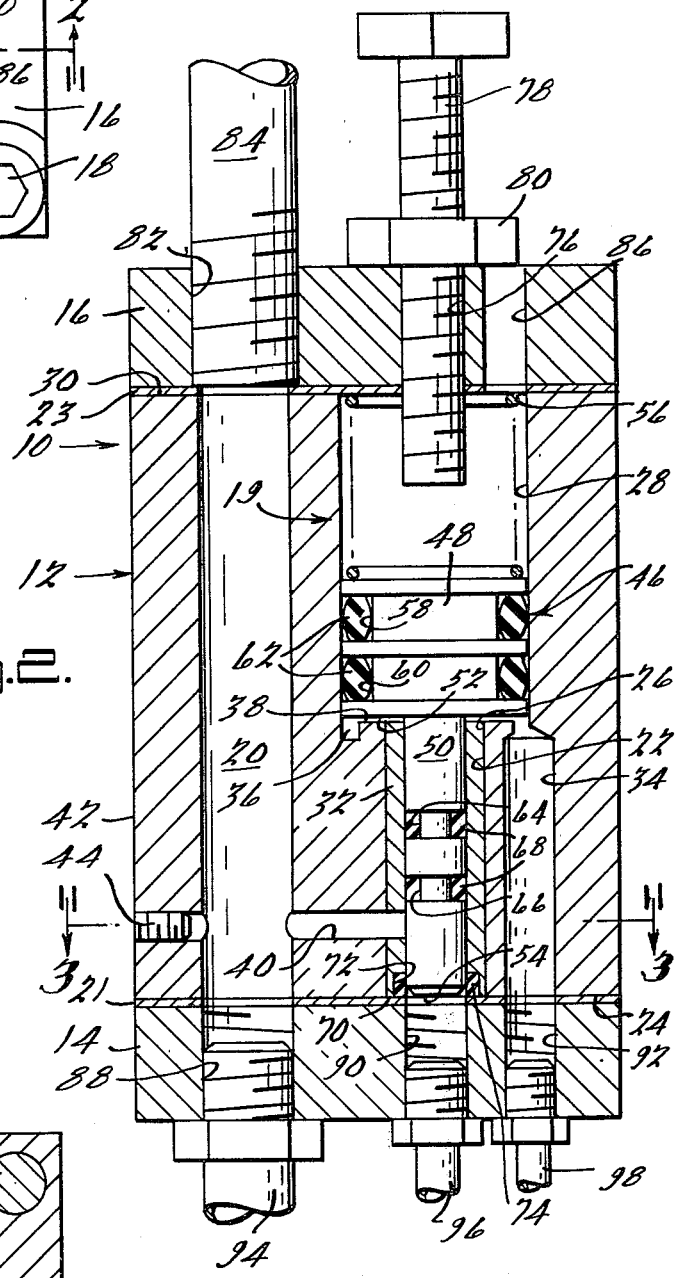
FIG. 2 is a longitudinal section view of the spray assembly of the present invention showing the improved valving arrangement, the section being taken along line 2—2 of FIG. 1.
Figure 3:
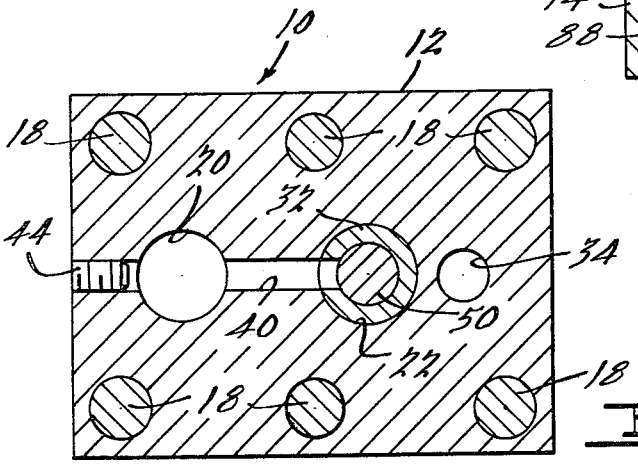
FIG. 3 is a section view of the spray assembly of FIG. 2, the section being taken along line 3—3 thereof.

As best seen with reference to FIG. 2, main body housing 12 has a relatively large main fluid passage 20 of substantially constant diameter extending longitudinally therethrough adjacent one side. A second generally centrally disposed longitudinal fluid passage 22 extends inwardly in substantially parallel spaced relationship to passage 20 from one end 24 of main body housing and has an inner end 26 which opens into a substantially larger diameter bore 28 extending inwardly from the opposite end 30 of main body housing 12. A tubular insert 32 preferably of a relatively strong abrasive resistant material such as stainless steel is press fitted within passage 22 and has a length substantially coextensive therewith.

A third longitudinally extending passage 34 also extends inwardly from end 24 of main body housing in substantially parallel spaced relationship to passages 20 and 22 and opens into an annular recess 36 provided at the inner end 38 of bore 28. As shown, bore 28 and passage 22 are positioned in substantially coaxial relationship. A transversely extending passage 40 is also provided in main body housing 12 extending laterally generally perpendicular to the axis of and substantially radially into both passages 20 and 22. As shown, passage 40 may be easily provided in housing 12 by drilling inwardly from the outer sidewall 42 and then inserting a suitable plug 44 in the outer portion of the drilled hole.

Liquid supply valving assembly 19 comprises a movable valve member 46 which includes a relatively large diameter piston 48 at one end thereof which is movably disposed within bore 28 and a generally cylindrically shaped plunger portion 50 integrally formed therewith and extending axially movably into tubular insert 32. Valve member 46 has a length such that when the inner radially extending surface 52 of piston portion 48 engages the inner end wall 38 of bore 28, the terminal end portion 54 of plunger portion 50 will extend beyond laterally extending passage 40. Suitable biasing means 56 in the form of a helical coil spring is also provided within bore 28 being operative to bias valve member 46 into a closed position as shown.

Piston portion 48 of valve member 46 is also provided with a pair of axially spaced annular grooves 58 and 60 within which suitable sealing means 62 such as a pair of O-rings are provided which sealingly engage the sidewalls of bore 28. Similarly, plunger portion 50 of valve member 46 also has a pair of axially spaced annular grooves 64 and 66 provided thereon within which suitable sealing means 68 such as O-rings or the like are provided which sealingly engage the inner sidewalls of insert 32 and operate to prevent axial leakage of fluids thereacross.

The outer end portion 70 of insert 32 is also provided with a relatively small annular recess 72 within which an annular seal 74 is fitted which is adapted to sealingly engage the terminal end of portion 54 of plunger 50 when valve member 46 is in a fully closed position as shown so as to prevent fluid flow into insert 32 thereby effectively sealing off passage 40. Preferably, plunger portion 50 will have a diameter slightly less than the inside diameter of insert 32.

In order to limit the axial travel of valve member 46, outlet plate 16 is provided with a threaded opening 76 through which an elongated stop member 78 extends. A jam nut 80 is also provided on stop member 78 so as to enable it to be locked in position.

Outlet plate 16 is also provided with another opening 82 aligned with passage 20 which is adapted to receive a suitable spray head or extension tube 84. A vent passage 86 is also provided in outlet plate 16 adjacent opening 76 which communicates with bore 28 and enables air contained therein to be vented to atmosphere upon actuation of valve member 46 thereby facilitating rapid movement thereof.

Inlet plate 14 is generally rectangular in shape and has three openings 88, 90, and 92 extending therethrough which are positioned in alignment with respective passages 20, 22 and 34 provided in main body housing. Opening 88 is adapted to have a suitable compressed air supply line 94 connected thereto whereas opening 90 will have a fluid or liquid supply line 96 connected thereto. A control air supply line 98 is connected to opening 92 and is used to control operation of valve member 46.

In operation, be it in conjunction with a reciprocating arm assembly or from a stationary location, a source of compressed air controlled by remote valves means not shown will be supplied to passage 20 via supply line 94. Similarly, a source of pressurized liquid such as a die lubricant, release agent or the like which is desired to apply to the working surfaces of the forming apparatus is supplied to passage 22 via supply line 96. A source of control air is also supplied to spray assembly via supply line 98 connected in fluid communication with passage 34.

Initially, remotely located valving means will be actuated so as to allow a flow of compressed air to flow through passage 20. This air may initially be used to clean scale, sediment or other debris from the die working surfaces if desired prior to application of the liquid. Thereafter control air, the supply of which is also controlled by remote valving, will be supplied to passage 34 and flow therethrough into annular recess 36 thereby causing piston 48 of valve member 46 to move rapidly axially upward as shown in drawings. This rapid axial movement of valve member 46 will operate to move plunger portion 50 axially upwardly and outwardly of passage 22 thereby enabling the liquid which will be sprayed to flow longitudinally through passage 22 and transverse passage 40 into the flowing air stream in passage 20 where it will be atomized and carried out through the tube or nozzle assembly 84 secured to the outlet plate 16 and onto the working surfaces of the die. Because of the provision of the annular recess 36 within bore 28 which enables the control air to act on a relatively large surface area of piston 48 and the fact that the area of bore 28 located above piston 48 as shown in the drawings is vented to atmosphere via passage 86, the valve member 46 will be moved into a fully open position very rapidly thereby providing what may be referred to as a "hydraulic jump" in which substantially full pressurized liquid flow is obtained almost immediately and the liquid is allowed to "explode" into the air flow through passage 20 thereby enabling relatively large volumes of liquid to be applied very rapidly. When the control air pressure is released, which may be accomplished by remote valving, biasing spring 56 will operate to rapidly move valve member 46 axially downwardly into a closed position such as that shown in FIG. 2. Again, passage 86 will allow atmospheric air to flow inwardly as valve member 46 moves axially downwardly thereby enabling rapid interruption of liquid flow through spray assembly 10.

It should also be noted that when valve member 46 is in a fully open position, plunger portion 50 will be located axially above transverse passage 40 thereby allowing substantially unobstructed fluid flow through passage 22. However, if in some applications it is desired to modulate or reduce the liquid to air ratio being sprayed, the stop member 78 may be adjusted axially inwardly so as to limit the axial upward movement of valve member 46 whereby plunger 50 only partially uncovers passage 40 thereby allowing only a reduced volume of fluid flow therethrough. Also, because the liquids with which such spray devices are to be used may contain some relatively abrasive particles, the provision of a stainless steel insert within passage 22 will greatly increase the life of the spray assembly by reducing the wear resulting from both fluid flow therethrough.

Therefore, it will be appreciated that the present invention provides an improved spray assembly which is relatively inexpensive to manufacture yet provides an extremely reliable fast-acting multiple purpose valving whereby both air only or air and liquids may be rapidly applied to the working surfaces of forming apparatus such as dies or molds.

While it will be apparent that the preferred embodiment of the invention disclosed is well calculated to provide the advantages and features above stated, it will be appreciated that the invention is susceptible to modification, variation and change without departing from the proper scope or fair meaning of the subjoined claims.

We claim:

1. In a spray apparatus for selectively applying one or more fluid to the working surfaces of forming apparatus, improved valve means for controlling the flow of said one or more fluids comprising:

a main body housing;

a first elongated fluid passageway extending substantially linearly through said main body housing and having an inlet at one end and an outlet at the other end;

a second fluid passageway spaced from said first passage extending into said housing and having an inlet at one end thereof;

a substantially unrestricted connecting passage having one end opening into said first fluid passage intermediate the ends thereof and the other end opening into said second fluid passage;

valve means disposed within said second fluid passage and movable into and out of overlying relationship to said port so as to selectively control fluid flow from said second fluid passage to said first fluid passage via said connecting passage; and actuating means for selectively moving said valve means out of overlying relationship, said actuating means being operable independently of fluid flow through said first fluid passageway whereby said fluid flow through said first passage may continue after movement of said valve member into overlying relationship to said port thereby enabling said fluid flow to evacuate said connecting passage.

2. A spray apparatus as set forth in claim 1 wherein said one end of said connecting passage opens into a sidewall defining said first fluid passage with the longitudinal axis of said connecting passage being substantially perpendicular to the longitudinal axis of said first fluid passage.

3. In a spray assembly for use in selectively applying one or more fluids to the working surfaces of forming apparatus, improved valve means for controlling the flow of said one or more fluids comprising:

a main body housing;

main fluid passage means extending through said main body housing for conducting a first fluid to be applied to said working surfaces including first inlet means;

another fluid passage extending into said housing including second inlet means;

a relatively short substantially unrestricted connecting passage means for placing said another fluid passage in fluid communication with said main fluid passage whereby a second fluid may be applied to said working surfaces with said first fluid, one end of said connecting passage defining a port at its juncture with said another fluid passage;

a bore provided within said housing;

valve means including a plunger movably disposed within said another fluid passage and piston means movably disposed within said bore and operative to move said plunger out of overlying relationship to said port;

biasing means for urging said piston into a first position toward one end of said bore and in which said plunger is positioned within said another fluid passage in overlying position to said port so as to prevent fluid communication between said connecting fluid passage means and said another fluid passage means; and pressure actuating means for moving said piston out of said first portion whereby said plunger is moved outwardly of said another passage thereby uncovering said port so as to enable said second fluid to flow through said another passage said port and said connecting passage into said main fluid passage the fluid flowpath being substantially unrestricted from said port to said main fluid passage whereby both said first and second fluids may be simultaneously applied to said working surfaces, said pressure actuating means including third inlet means for providing a supply of control actuating pressure fluid to said piston means.

4. A spray assembly as set forth in claim 3 wherein said bore has a recess provided at said one end of said bore, and a control passage means opening into said recess whereby said pressurized control fluid may substantially instantaneously operate upon a substantial surface area of said piston means so as to rapidly move said piston out of said first position.

5. A spray assembly as set forth in claim 4 wherein the other end of said bore is vented to atmosphere so as to facilitate rapid movement of said piston means.

6. A spray assembly as set forth in claim 3 further comprising a tubular insert fitted within said another fluid passage, said insert being operative to reduce wear of said another fluid passage resulting from flow of said second fluid therethrough.

7. A spray assembly as set forth in claim 6 wherein said insert is fabricated from a stainless steel.

8. A spray assembly as set forth in claim 6 wherein said insert has a recess adjacent one end thereof and further comprising sealing means disposed within said recess, said sealing means being engageable with said plunger when said piston is in said first position so as to effectively prevent flow of said second fluid.

9. A spray assembly as set forth in claim 3 wherein said main and said another fluid passages are positioned in substantially parallel spaced relationship.

10. A spray assembly as set forth in claim 9 wherein said connecting passage means has an axis positioned substantially perpendicular to the axis of said main fluid passage.

11. A spray assembly as set forth in claim 3 wherein said plunger is moved outwardly of said another fluid passage a distance sufficient to provide a substantially unrestricted flow path through said another fluid passage to said connecting fluid passage when said valve means is actuated to a fully open position.

12. A spray assembly as set forth in claim 3 wherein said bore and said another passage means are positioned coaxially and said piston and said plunger are integrally formed.

13. A spray assembly as set forth in claim 3 further comprising adjustable stop means operative to limit movement of said plunger outwardly of said another passage whereby the maximum volume of flow of said second fluid may be controlled.

14. A spray assembly as set forth in claim 13 wherein said stop means comprises a threaded member extending into said bore from another end, said member being engageable with said piston so as to limit movement of said plunger.

15. A spray assembly comprising:

an elongated main body housing;

a first longitudinally extending fluid passage within said main body housing, said first passage being of substantially constant cross sectional size throughout its length and having fluid inlet means at one end and fluid outlet means at the other end;

a second longitudinally extending fluid passage within said main body housing positioned in substantially parallel spaced relationship to said first fluid passage, said second fluid passage having a fluid inlet at said one end of said main body housing;

a substantially unrestricted relatively short transverse fluid passageway extending between and opening into said first and second passages intermediate the ends thereof;

a longitudinally extending bore provided in said main body housing, said bore being coaxial with said second passage;

valve means including piston means movably disposed within said bore and a plunger portion extending axially into said second fluid passage;

biasing means for urging said plunger portion into said second fluid passage and into overlying relationship to the opening of said transverse fluid passage into said second passage whereby said plunger portion operates to prevent fluid flow through said second passage; and pressure actuating means for axially moving said piston means and said plunger portion toward said another end whereby fluid may flow through said second passage to said transverse passage and into said first passage, said pressure actuating means including third inlet means for providing a supply of control actuating pressure fluid to said piston means.

16. A spray assembly as set forth in claim 15 wherein said actuating means comprises a control fluid passage being operative to conduct pressurized control fluid from said third inlet to said bore.

17. A spray assembly as set forth in claim 16 wherein said bore has an annular recess at the inner end thereof, said control fluid passage opens into said recess whereby said pressurized control fluid may simultaneously act on an entire peripheral surface area of said piston means whereby said valve means may be rapidly actuated.

18. A spray assembly as set forth in claim 15 further comprising vent means for venting said bore to atmosphere.

19. A spray assembly as set forth in claim 15 further comprising stop means extending adjustably into said bore, said stop means being engageable with said piston means so as to limit axial movement thereof whereby the amount of fluid flow from said second passage to said transverse passage may be controlled.

* * * * *

UNITED STATES PATENT AND TRADEMARK OFFICE

CERTIFICATE OF CORRECTION

PATENT NO. : 4,365,754

DATED : December 28, 1982

INVENTOR(S) : Levine, Walter E., Heath, Allan B.

It is certified that error appears in the above-identified patent and that said Letters Patent are hereby corrected as shown below:

Column 3, line 67, "valves" should be --valve--

Column 4, line 17, insert the word --the-- after "in"

Column 5, line 2, "or" should be -- and --

Column 6, line 11, "portion" should be --position--

Column 5, line 12 "fluid" should be --fluids--

Signed and Sealed this

Fifth Day of April 1983

[SEAL]

*Attest:*

GERALD J. MOSSINGHOFF

*Attesting Officer*

*Commissioner of Patents and Trademarks*